United States Patent [19]

Betz

[11] Patent Number: 4,855,704

[45] Date of Patent: Aug. 8, 1989

[54] JOYSTICK FOR GENERATING ELECTRIC CONTROL SIGNALS

[75] Inventor: Manfred Betz, St. Johann-Gächingen, Fed. Rep. of Germany

[73] Assignee: Gustav Magenwirth GmbH & Co., Urach, Fed. Rep. of Germany

[21] Appl. No.: 210,649

[22] Filed: Jun. 23, 1988

[30] Foreign Application Priority Data

Jul. 3, 1987 [DE] Fed. Rep. of Germany ..... 3722046

[51] Int. Cl.[4] ..... H01F 21/06

[52] U.S. Cl. ..... 336/132; 336/135; 340/870.31

[58] Field of Search ..... 340/870.31, 870.32, 340/870.35, 870.36; 336/30, 132, 130, 133, 134, 135, 79

[56] References Cited

U.S. PATENT DOCUMENTS 3,193,784 7/1965 Lautzenhiser ..... 336/30
4,306,208 12/1981 Coors ..... 336/30

FOREIGN PATENT DOCUMENTS 3504387 2/1985 Fed. Rep. of Germany .
2428867 6/1978 France .

OTHER PUBLICATIONS

*Elektronik*, "Elektronik Notizen, " 11/29.5, 1987, p. 40.
*Patents Abstracts of Japan*, vol. 8, No. 157, 1984 (Abstract of Japanese Appl. 57-164349 of 9/21/82).
*IBM Technical Disclosure Bulletin*, vol. 27, No. 8, 1985, pp. 4732-4733.

*Primary Examiner*—Thomas J. Kozma
*Attorney, Agent, or Firm*—Neuman, Williams, Anderson & Olson

[57] ABSTRACT

A joystick for generating electric control signals comprises the following components: a housing, an operating rod, a universal joint for the operating rod, sensors and an element acting upon these in a positionally dependent manner. The distance of the element from the sensors can be varied by the operating rod. The sensors are in the form of induction coils through which alternating current circulates. The induction coils, in turn, are each part of an electric oscillatory circuit. It is adequate to provide only two such sensors. The element acting upon the induction coils is an induction body, more particularly, in the form of a spherical part which is rigidly connected to the operating rod. The center of the induction body is spaced from the center of the universal joint. By changing the distance of the induction body from the induction coils, the amplitude, frequency and/or phase of the respective oscillatory circuit can be changed in order to generate the electric control signals.

11 Claims, 3 Drawing Sheets

JOYSTICK FOR GENERATING ELECTRIC CONTROL SIGNALS

The invention relates to a joystick for generating electric control signals as defined in the preamble of Patent claim 1.

Joysticks of this kind are used in remote control systems, for example, in machines such as excavators, cranes or the like.

A joystick of the generic kind is described, for example, in German published Patent Application 3,504,387. Further joysticks for the generation of electric control signals are known from the German periodical "Elektronik 1987", 40; French published Patent Application 2,428,867; Japanese publication 59-53936 (A): Patents Abstracts of Japan P-288, July 20, 1984, Vol. 8, No. 157 and the U.S. journal: IBM Technical Disclosure Bulletin, Vol. 27, No. 8, January 1985, pages 4732 to 4733.

The mechanical and electrical design of the known joysticks is complicated and prone to failure.

The object of the invention is to simplify the mechanical and electrical design and the mode of operation of a joystick of the generic kind, thereby increasing its operational reliability and simultaneously reducing the production costs.

The object is accomplished in accordance with the invention by the characterizing features of Patent claim 1.

In comparison with known joysticks, the joystick according to the invention is of simpler mechanical and electrical design and its mode of operation is very simple and reliable. In addition, the joystick proposed by the invention can be produced at comparatively reasonable cost.

The following description of preferred embodiments serves in conjunction with the appended drawings to explain the invention in further detail.

Figure 1:
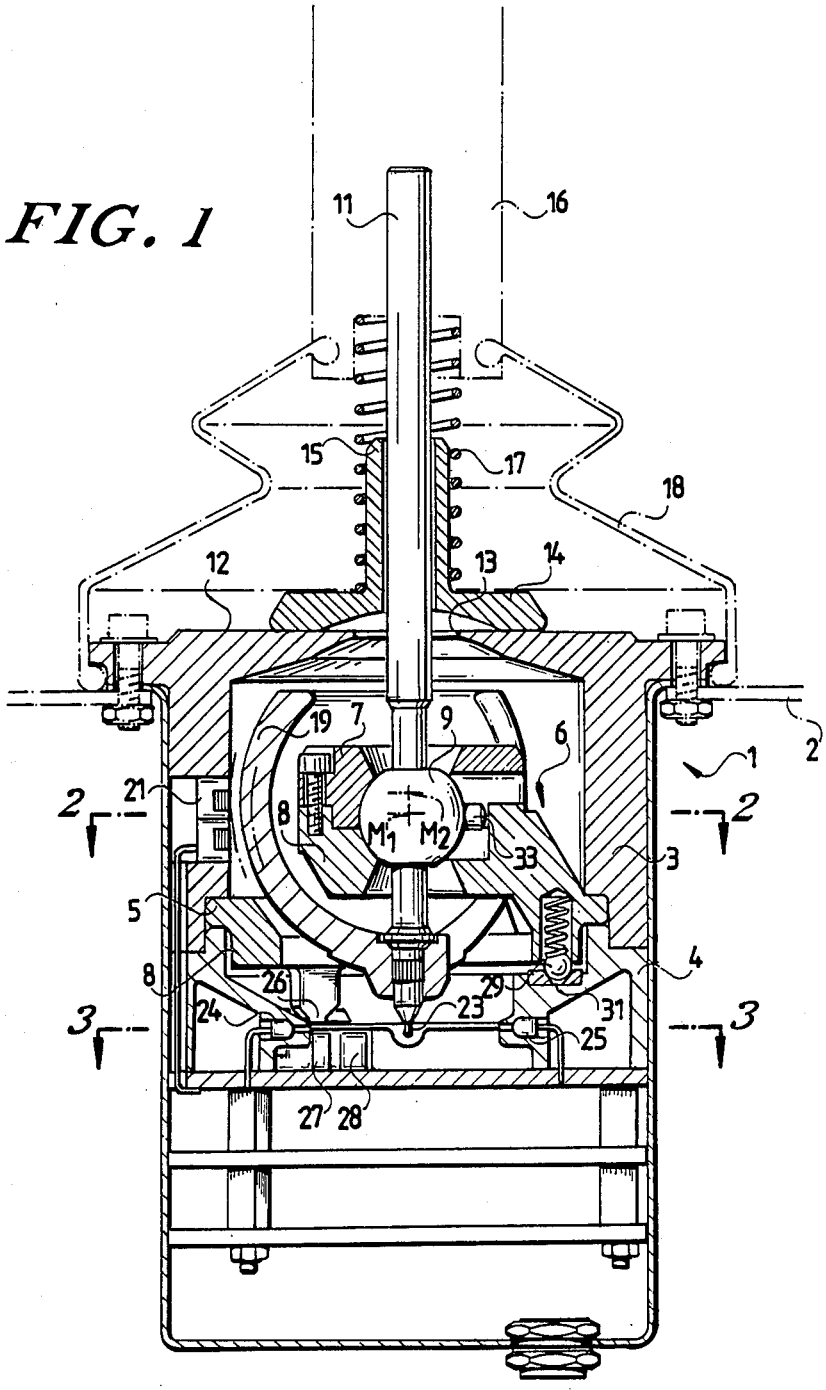
FIG. 1 is an axial sectional view of a joystick for generating electric control signals, with some parts shown schematically.

As shown in FIG. 1, a housing 1 is attached to an immobile part 2 of the structure of an excavator or a similar machine. Between a first part 3 of the housing and a second part 4 of the housing, a ball socket 6 is rotatably supported by an annular colar 5, with the axis of rotation extending in the drawing plane of FIG. 1 and perpendicularly to collar 5. The ball socket 6, in turn, consists of socket parts 7 and 8 bolted together, with the collar 5 mentioned above being formed on socket part 8. The socket parts 7 and 8 together form a ball cup in which a joint ball 9 can be universally rotated. The center of the joint ball 9 is designated M1 in FIG. 1. The socket 6 and the ball 9 constitute a universal joint, the center of rotation of which is located at M1.

An operating rod 11 is rigidly attached to the joint ball 9 and is, therefore, pivotable in all directions via the univeral joint mentioned above. The top surface 12 of housing part 3 has an opening 13 surrounding the operating rod 11 without touching it. The opening 13 is covered by a repositioning disc 14 which slides on the top surface 12. A bushing 15 is integrally attached to the repositioning disc 14 or forms part of it and the operating rod 11 passes through the bushing. A handle 16 is attached to the free end of the operating rod 11. A helical compression spring 17 placed between the handle 16 and the repositioning disc 14 attempts to return the pivoted operating rod 11 into the zero position (as shown in FIG. 1) when the repositioning disc 14 has slid laterally and has been tilted on the top surface 12 by the pivoting motion of the operating rod 11. A bellows 18 installed between the handle 16 and the immobile part 2 of the machine prevents the entry of dirt into the housing 1.

The operating rod 11 extends beyond the joint ball 9 and carries an induction body 19 there in the form of part of a hollow sphere. The center M2 of the hollow sphere forming the induction body 19 is located eccentrically (in Figure 1 upwards) with respect to the center M1 of the joint ball 9. Two induction coils 21, 22 are firmly arranged as sensors in housing 1 (cf. also FIG. 2). The axes of the coils intersect at the center M1 of the joint ball 9. The plane defined by these coils extends perpendicularly to the zero position of the operating rod 11. With respect to the axis of the operating rod 11, the induction coils 21, 22 include an angle of 90 degrees. Each of the induction coils 21, 22 forms part of an electric oscillatory circuit known per se and associated with alternating currents of specific amplitude, frequency and phase which also circulate through coils 21, 22.

If the operating rod 11 is tilted in any direction, the distance between the hollow-sphere-type induction body 19 and the induction coils 21, 22 changes due to the eccentricity between the joint ball 9 and the induction body 19. This change in distance influences the induction coils 21, 22 inductively in such a manner as to cause characteristic changes in the amplitude, frequency and/or phase of the currents flowing in the oscillatory circuits associated with the induction coils. These changes can be utilized in a known way for the generation of electric control signals which are related to the angular positions of the joystick described herein and comprised of the operating rod 11 and the handle 16. These control signals can, in turn, be utilized for controlling the motion of machines, for example, the scoop of an excavator.

The electrical and mechanical design of the joystick described herein is extremly simple, rugged and operationally reliable. In particular, merely two induction coils are required as sensors. If the induction body 19 is of suitable geometrical design, which may include shapes other than the spherical configuration, tilting of the joystick in one direction may not necessarily change the measured value in the opposite direction. In the known joysticks, usually several coils are placed around the joystick and continuous mutual computation and evaluation of the individual measured values of the coils is required. In principle, it is, however, also possible for more than two sensors to be provided in the joystick described herein without negatively affecting the simplicity of the design and further advantages.

Figure 3:
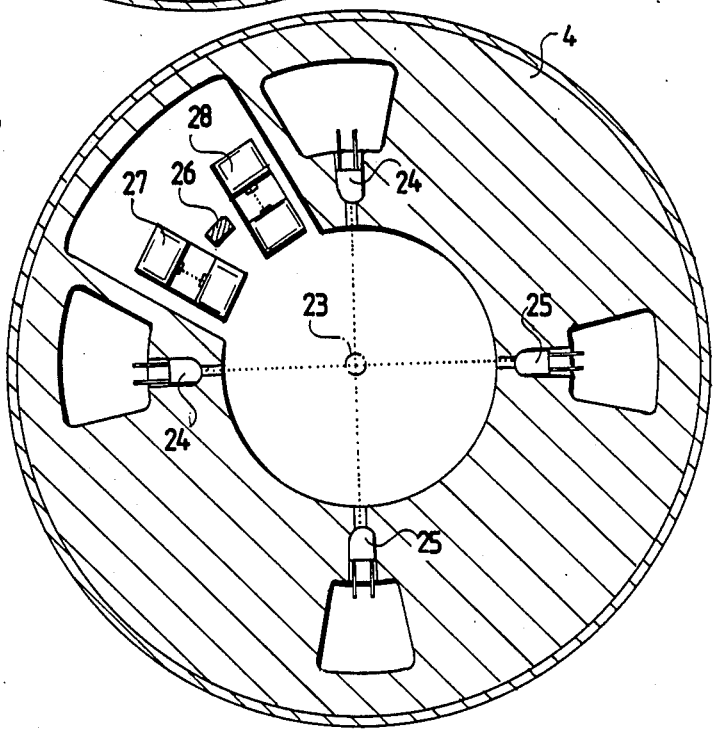
FIG. 3 is a sectional view taken along line 3—3 in FIG. 1.

At an extension continuing beyond the induction body 19, the operating rod 11 carries a comparatively short pin 23, the surface of which, for example, due to a matte black finish, does not reflect light. In the zero position of the operating rod 11, this pin 23 is located precisely at the point of intersection of two light barriers (FIG. 3) which are essentially perpendicular to each other and are each comprised in a known way of a transmitter 24 and a receiver 25. This arrangement allows detection and verification of the zero position of the operating rod. If the operating rod should not be in the zero position, at least one of the light barriers will furnish a signal indicative of this.

As mentioned above, the ball socket 6 and hence the entire universal joint is supported for rotation inside housing 1 by the collar 5 of socket part 8 which engages between housing parts 3 and 4. Accordingly, the universal joint can be rotated within housing 1 to generate additional control signals (without influencing the induction coils 21, 22 by the spherical induction body 19). For this purpose, a narrow lug 26 extends downwards from the socket part 8. By rotating the socket 6, the lug 26 can be brought alternatively into the path of light of the fork-shaped light barriers 27, 28 (FIG. 3) to generate additional control signals by the angular rotation of the joystick.

A spring-loaded ball 29 which can engage dimples 31, 32 fixed in the housing (FIG. 2) to achieve a detent-type action is arranged in socket part 8. The dimples 31, 32 are coordinated with the angular rotational positions of the socket 6 in which the lug 26 interrupts the path of light in the light barriers 27, 28, respectively. A further dimple for the ball 29 may be provided between dimples 31, 32 to define the zero position of the lug 26 and hence of the socket 6 between the light barriers 27, 28.

Figure 2:
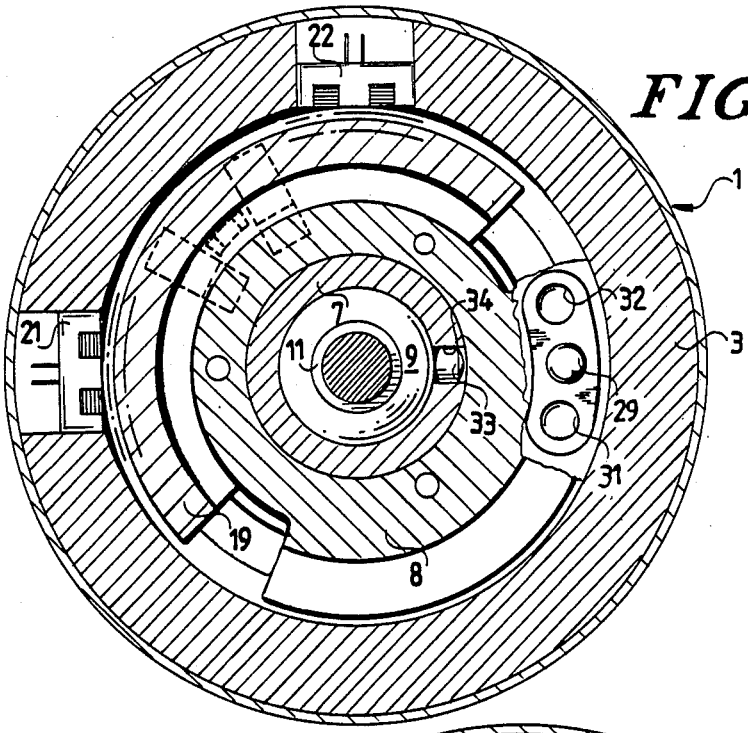
FIG. 2 is a sectional view taken along line 2—2 in FIG. 1.

To ensure positive transmission of the rotation of the operating rod 11 about its longitudinal axis to the socket 6, a cylindrical actuating pin 33 protrudes laterally from the joint ball 9. The longitudinal axis of the pin 33 coincides with the longitudinal axis of the induction coil 21 and runs through the center of the joint ball 9. Accordingly, the actuating pin 33 does not obstruct tilting motion of the operating rod 11 in a plane perpendicular to the drawing plane of FIG. 1. The actuating pin 33 also positively engages a groove 34 formed in socket parts 7, 8 (FIG. 2). This configuration ensures, on the one hand, positive rotation of the socket 6 along with rotation of the operating rod 11 about its longitudinal axis and, on the other hand, tilting motion of the operating rod 11 in the drawing plane of FIG. 1.

Figure 4:
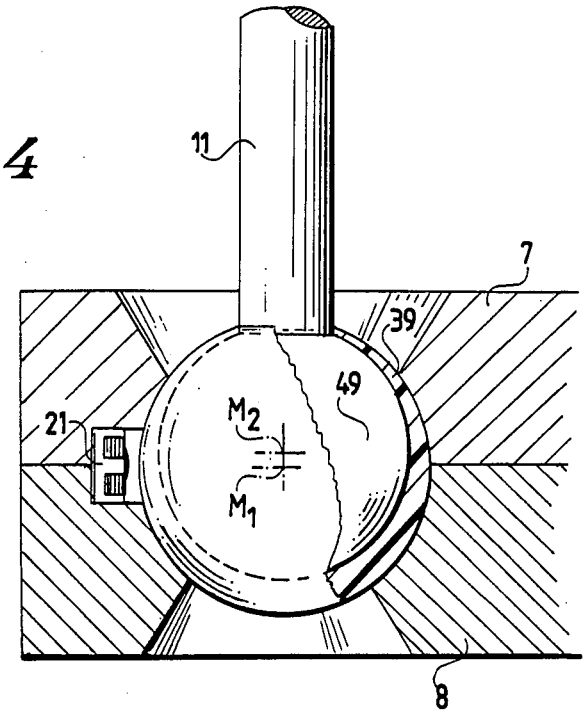
FIG. 4 is a schematic view of an embodiment of a joystick representing a modification of the joystick of FIG. 1.

In the modified embodiment of a joystick shown schematically only in FIG. 4, the operating rod 11 is rigidly attached to a joint ball 39 made of an electro-inductively neutral material such as, for example, plastic material. An induction body 49, preferably in the form of a metallic sphere, is located inside of the joint ball 39 and is likewise rigidly attached to the operating rod 11, with the centers M1 and M2 of the two spheres 39 and 49 being spaced apart in the same way as indicated in FIG. 1. The joint ball 39 is enclosed by two socket parts 7, 8 which, in this case, may also accommodate the sensors (induction coil 21). Otherwise, the mode of operation of the embodiment according to FIG. 4 corresponds to that of the embodiment according to FIG. 1.

The present disclosure relates to the subject matter disclosed in German application No. P 37 22 046.2 of July 3, 1987, the entire specification of which is incorporated herein by reference.

What is claimed is:

1. Joystick for generating electric control signals comprising a housing, an operating rod, a universal joint which is arranged in said housing and on which said operating rod is movably mounted, sensors arranged in said housing and an element acting upon said sensors in a positionally dependent manner, the distance of said element from said sensors being variable by said operating rod, said sensors being in the form of induction coils through which alternating current circulates, said induction coils each being part of an electric oscillatory circuit, said element acting upon said induction coils being an induction body which is rigidly connected to said operating rod, and the amplitude, frequency and/or phase of the respective oscillatory circuit being changeable by changing the distance of said induction body from said induction coils in order to generate the electric control signals, characterized in that the longitudinal axis of said induction coils (21, 22) intersect in the center (M1) of said universal joint (6, 9, 7, 8; 39) which is designed as a ball-and-socket joint, in that in its zero position, said operating rod (11) extends perpendicularly to the plane defined by the longitudinal axes of said induction coils (21, 22), and in that said induction body (19) is part of a sphere, the center (M2) of which is spaced from said center (M1) of said universal joint perpendicular to this plane.

2. Joystick as defined in claim 1, characterized in that said induction coils (21, 22) are two in number, said induction coils including an angle of generally 90 degrees with respect to the axis of said operating rod (11).

3. Joystick as defined in claims 1 or 2, characterized in that said universal joint is a ball-and-socket joint with a socket (6) and a joint ball (9).

4. Joystick as defined in claim 1, characterized in that said induction body is a spherical shell part arranged on the outside of said joint ball (9).

5. Joystick as defined in claim 1, characterized in that said joint ball (39) consists of an electrically neutral plastic material and said induction body is a spherical part (49) arranged inside of said joint ball.

6. Joystick as defined in claims 1, 2, 4 or 5 characterized in that said operating rod (11) carries on an extension a pin (23) which does not reflect light, said pin extending into a path of two light barriers (24, 25) arranged in said housing (1) and interrupting both light barriers when said operating rod is in its zero position.

7. Joystick as defined in claim 3, characterized in that said ball socket (6) is mounted in said housing (1) for rotation about the axis of said operating rod (11), and an actuating pin (33) is arranged on said joint ball (9) for positive transmission of the rotation of said operating rod about its axis to said ball socket (6), and in that a lug (26) is arranged on said ball socket (6) to interrupt at least one light barrier (27, 28) when said ball socket is in a rotated position.

8. Joystick as defined in claim 7, characterized in that the angular rotational position of said ball socket (6) in which said light barrier (27, 28) is interrupted is defined by ball (29) designed for detent-type action.

9. Joystick as defined in claim 3, characterized in that said induction body is a spherical shell part arranged on the outside of said joint ball (9).

10. Joystick as defined in claim 3, characterized in that said joint ball (39) consists of an electrically neutral plastic material and said induction body is a spherical part (49) arranged inside of said joint ball.

11. Joystick as defined in claim 3, characterized in that said operating rod (11) carries on an extension a pin (23) which does not not reflect light, said pin extending into a path of two light barriers (24, 25) arranged in said housing (1) and interrupting both light barriers when said operating rod is in its zero position.

* * * * *